United States Patent [19]

Spitaler et al.

[11] Patent Number: 4,690,424

[45] Date of Patent: Sep. 1, 1987

[54] HEEL HOLDER, IN PARTICULAR FOR A RENTAL SKI

[75] Inventors: Englebert Spitaler, Wr. Neudorf; Hubert Wuerthner, Hainburn both of Austria

[73] Assignee: TMC Corporation, Baar, Switzerland

[21] Appl. No.: 823,552

[22] Filed: Jan. 29, 1986

[30] Foreign Application Priority Data

Feb. 1, 1985 [AT] Austria ..... 279/85

[51] Int. Cl.[4] ..... A63C 9/08

[52] U.S. Cl. ..... 280/633; 280/634

[58] Field of Search ..... 280/611, 633, 634

[56] References Cited

FOREIGN PATENT DOCUMENTS 276180 2/1969 Austria ..... 280/633

2451756 11/1980 France ..... 280/633

*Primary Examiner*—David M. Mitchell

*Assistant Examiner*—Richard Camby

*Attorney, Agent, or Firm*—Flynn, Thiel, Boutell & Tanis

[57] ABSTRACT

The underside of a heel holder is guided on a guide rail secured to the upper side of a ski. The guide rail has at least one set of toothed serrations associated with a locking member having corresponding counter serrations. The locking member can be pivoted about a transverse axis. The locking member projects beyond the heel holder toward the tail end of the ski and can be lifted against the force of a spring from and out of the locked position by means of a screw driver. After release by the screw driver, the locking member is swung by the spring into the locked position. A guard plate is provided for covering the teeth of the toothed serrations to prevent damage thereto by the screw driver.

8 Claims, 8 Drawing Figures

HEEL HOLDER, IN PARTICULAR FOR A RENTAL SKI

FIELD OF THE INVENTION

The invention relates to a heel holder, in particular for a rental ski, the underside of which heel holder is guided on a guide rail adapted to be secured to a ski, the guide rail having at least one toothed segment, the heel holder including a locking member which has at least one toothed segment which can be locked with respect to the guide rail and is biassed by at least one spring, which locking member is pivotal about a transverse axis on the heel holder and projects toward the tail end of the ski beyond the heel holder.

BACKGROUND OF THE INVENTION

Austrian Pat. No. 374 692 (which corresponds to U.S. patent application Ser. No. 510 458, filed July 1, 1983) describes an apparatus for the longitudinal adjustment of ski binding parts having a guide rail which is secured to a ski, which guide rail has two lateral guide edges each with a row of serrations thereon arranged between said guide edges and extend in the longitudinal direction of the apparatus. A locking member is associated with the toothed serrations and is under the influence of at least one compression spring which is supported at its end remote from the locking member on a guide plate which is guided on the guide rail and carries the heel holder thereon and which—viewed from the side—has approximately an upwardly open U-shaped cross section, whereby the crosswise extending web which connects the two legs has locking teeth thereon. One leg of the locking member lies in this apparatus under the influence of the compression spring on an inwardly projecting shoulder of the guide plate, and the other leg is lockable in the lifted position of the locking member, thus when the locking teeth are disengaged from the toothed bars.

It has been found in this apparatus that in practice the adjusting of the heel holder, which must be carried out very often in a rental ski, does not always occur with the necessary caution. The screw driver which is used for the adjustment is namely often applied with such force and thereafter swung upwardly in a vertical plane, that damage to the sensitive teeth of the toothed serrations occurs. This damage can at times be so great that the teeth on the locking member can be inserted only with great difficulty into the toothed serrations or that the teeth of the toothed serrations are deformed such that they no longer can reliably hold the locking member, which then during the downhill skiing jumps out of the toothed serrations.

It has furthermore been suggested to equip the heel holder itself with an apparatus to facilitate its longitudinal adjustment (see French Pat. No. 2 451 756). The guide rail is in this apparatus provided with two rows of holes, into two holes in each row extend two projections of a locking member, urged under the influence of a helical spring and against the guide rail in the locked position of the apparatus. The locking member is supported, when the ski shoe is not inserted, on a downwardly projecting wall of the housing of the heel holder. It is constantly coupled with an approximately U-shaped wire bar, the bight portion of which, which extends in transverse direction with respect to the guide rail, is stored in a recess of the heel holder.

If the heel holder is to be adjusted along the length of the guide rail, then the wire bar and thus the locking member are lifted by means of a special tool in the form of a screw driver having two grooves therein arranged in the narrow-side surfaces of the blade and which extend inwardly of the plate toward the axis of the screw driver, by swinging the screw driver through a 90° angle. The heel holder can thereafter be moved along the length of the guide rail.

If the desired position of the heel holder is achieved, the screw driver is swung back through the 90° angle and is thereafter pulled out of the wire bar. This causes, due to the helical spring, the projections on the locking member to extend into the holes of the guide rail. This embodiment has the disadvantage that for adjusting the locking member, a specially constructed tool must be used. Furthermore, the tool must, during the adjusting operation, remain in engagement with the binding part, which occupies one hand of the installer for this purpose and only the other hand of the installer is available for other adjusting operations.

The purpose of the invention is to provide a heel holder of the abovementioned type in which during a longer use and repeated adjustment, no damage to the toothed serrations on the guide rail can occur, whereby for the adjusting operation itself only a commercially available screw driver is needed.

This purpose is inventively attained by arranging a guard plate below the locking member, which guard plate covers mainly the section of the serrations or the like, which is opposite the free end area of the locking member. With this the mentioned section cannot be damaged, not even in the case of a rough treatment by the applied screw driver.

In order to assure a snug bearing of the guard plate on the guide rail and in order to prevent a bending of the same even when the locking member is swung up by the screw driver, the invention provides that the guard plate, for example by means of upwardly bent sections which have slotted holes therein, is pivotally supported for movement about a transverse axis which consists for example of two coaxial axles on the locking member and is supported movably with respect thereto to a certain degree. It is thereby advantageous if the longitudinal axis of the slotted holes defines with the vertical plane an angle of up to 25°, preferably an angle of 15°.

It would actually be conceivable to extend the free end area of the locking member and to arrange the guard plate only under the tail end area of the locking member. This, however, could possibly lead to a bending of the locking member. For this reason the invention suggests a further development, namely, that the guard plate has a recess in its center area, which recess is designated for passage of the section of the locking member which has the teeth thereon.

A modification of the last-disclosed embodiment is characterized by a guard plate which is U-shaped in the top view being hingedly connected to the locking member by means of two laterally spaced arms which extend in longitudinal direction of the heel holder toward the spring. This modification brings about a certain saving of weight of the heel holder.

According to a further characteristic of the invention, the guard plate has in the section which follows the free end at least one, preferably two ribs which extend in transverse direction and which are constructed for example as upstanding bulges. This characteristic prevents any kind of sliding off of the screw driver from the guard plate in direction toward the teeth.

In order to thereby make easier the applying of the screw driver to the guard plate and to prevent a backward sliding off of the screw driver, the invention provides further that the rib which is adjacent to the free end of the guard plate is lower than the other rib which is farther from the end.

BRIEF DESCRIPTION OF THE DRAWINGS

Two exemplary embodiments of the subject matter of the invention are schematically illustrated in the drawings, in which

FIG. 6 is a view taken in the direction of the arrow VI of FIG. 7, and FIG. 7 is an enlarged, partially cross-sectioned view of the heel holder which is in the skiing position, and which partial cross-sectional view is taken through the longitudinally central plane, and FIG. 4*a* is a top view similar to FIG. 4.

DETAILED DESCRIPTION

Figure 1:
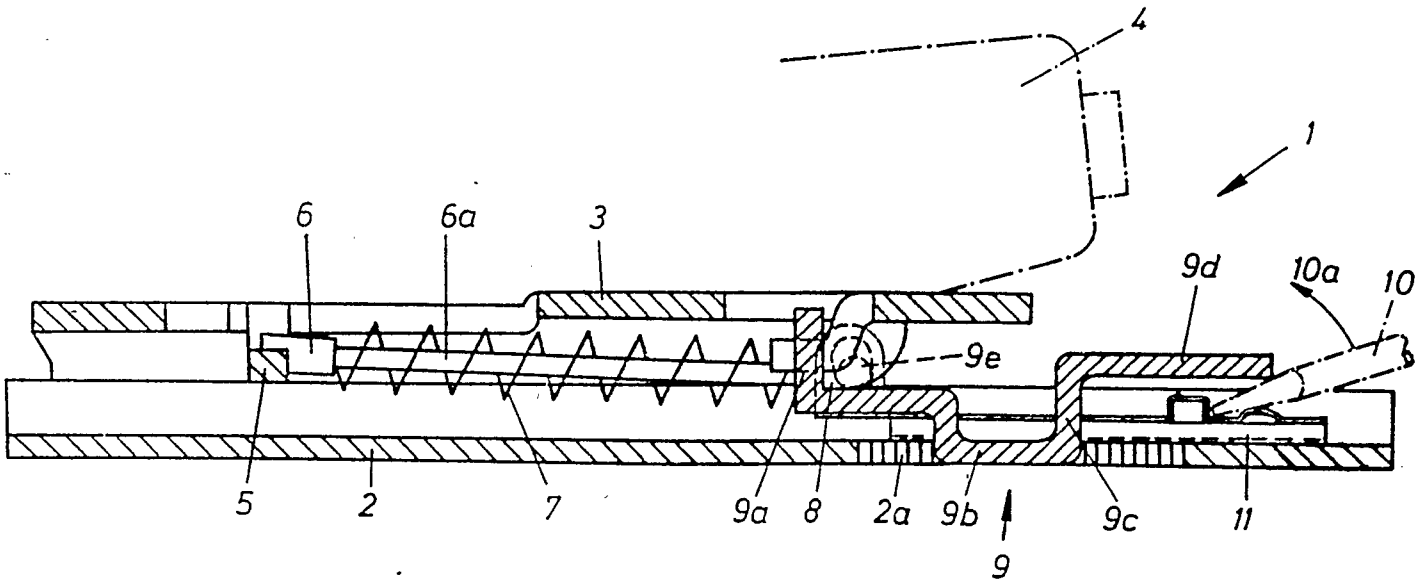
FIG. 1 is a longitudinally central cross section of an adjusting device which is provided on a heel holder and which is in a locked condition.
Figure 5:
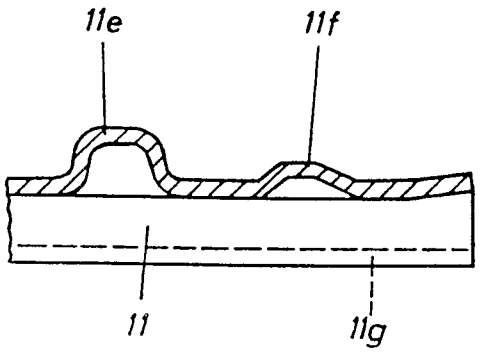
FIG. 5 is an enlarged cross-sectional view of a detail of the guard plate taken along the line V—V of FIG. 4.
Figure 2:
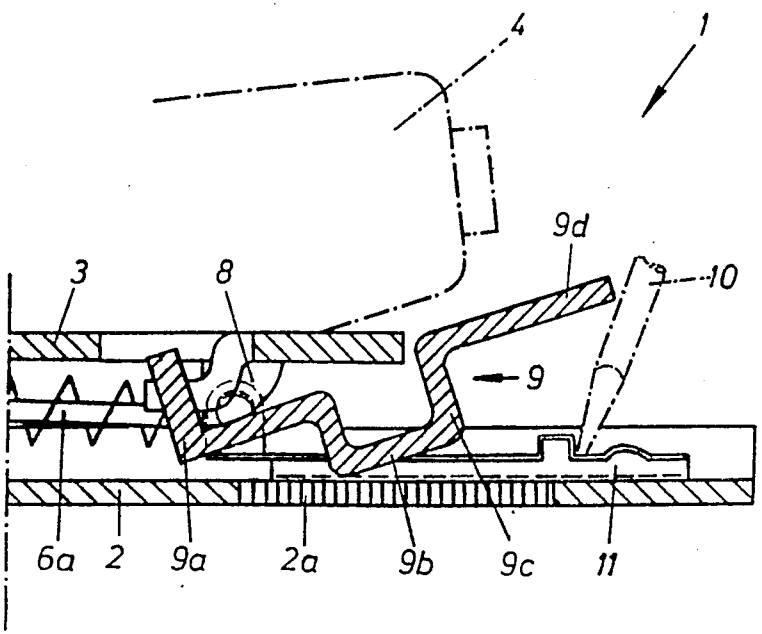
FIG. 2 illustrates a fragment of the adjusting device in the disengaged condition.

The adjustment device for adjusting the longitudinal position of heel holders or the like, which device is illustrated in FIGS. 1 and 2, is identified as a whole by the reference numeral 1. The adjustment device 1 consists of a guide rail 2 which is secured to the ski and which is provided with two laterally spaced guide bars and with a recess which extends centrally along its central longitudinal axis. The recess has toothed bars or serrations 2*a* along both sides thereof.

A guide plate 3 is movably guided on the guide rail 2, on which guide plate is secured a heel holder 4. A laterally extending cross member 5 is stamped or struck from the guide plate 3 and serves to support a crosswise extending part of a U-shaped guide element 6 which supports or has abutted thereagainst two compression springs 7. The guide plate 3 has furthermore on its underside two shoulders 8 which are designated for abutment with one leg 9*a* of an approximately U-shaped locking member 9. The leg 9*a* of the locking member 9 is a flat or plate-shaped member and has the ends of the two legs 6*a* of the guide element 6 each extend through an opening with play or clearance, so that the plate-shaped member is pressed against the shoulders 8 under the influence of the two compression springs 7, however, can be swung within a certain range with respect to the guide element 6. Furthermore, due to the mentioned play or clearance, a movement of the legs 6*a* of the guide element 6 relative to the leg 9*a* is by all means possible.

A crosswise extending web 9*b* of the locking member 9 has teeth thereon, which are designated for engagement with the toothed bars or serrations 2*a* on the guide rail 2. A leg 9*c* of the locking member 9 extends upwardly from the web 9*b* along an edge opposite the edge from which the leg 9*a* extends. The leg 9*a* is provided with an outwardly or rearwardly directed extension 9*d* which facilitates a lifting of the end of the locking member 9 by use of a screw driver 10.

Figure 3:
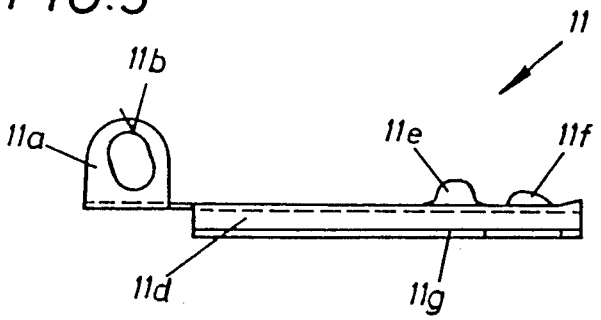
FIGS. 3 and 4 are side and top views, respectively, of the guard plate.

Directly below the locking member 9 there is provided a guard plate 11 which protects the two toothed rows of serrations 2*a* on the guide rail 2 against damage by the screw driver 10 and therefore covers the toothed serrations 2*a* in this area. The guard plate 11 has in its central region a rectangular-shaped recess 11*c*, which allows for passage of the web 9*b* of the locking member 9 in the locked position thereof. The guard plate 11 has adjacent an end area of its two longitudinal sides two upstanding bent sections 11*a*, into which slotted holes or recesses 11*b* are provided (see FIG. 3). Coaxial axles 9*e*, which are arranged horizontally and extend in a transverse direction relative to the length of the guard plate, extend into the slotted holes 11*b*, which coaxial axles 9*e* project laterally from the locking member 9.

The guard plate 11 has at the end which is opposite the hinge point provided by the bent sections 11*a* two transversely extending upstanding ribs 11*e* and 11*f* which are constructed as bulges, between which ribs 11*e* and 11*f* the end of the blade of a screw driver 10 can be inserted, as can be seen from FIGS. 1 and 2. Finally the guard plate 11, which is slightly U-shaped in cross section, has two laterally outwardly projecting flanges 11*g* coextensive with the two legs of the U and enable the guard plate to rest on the areas of the guide rail 2 which are transversely of the direction of the two toothed rows of serrations 2*a*. The guard plate 11 is guided and reinforced by the flanges 11*g*, so that even in the case of a very rough handling of the adjusting device during the adjusting operation, a denting of the guard plate 11 cannot occur.

The locking member 9 is in the skiing position of the heel holder 4 in the position which is illustrated in FIG. 1 and the two compression springs 7 function to urge the web 9*b* having teeth thereon into the toothed serrations 2*a* on the guide rail 2.

If the heel holder 4 is now to be adjusted in a longitudinal direction of the ski, the screw driver 10 is introduced between the two ribs 11*e* and 11*f* and is swung counterclockwise in direction of the arrow 10*a* (compare FIGS. 1 and 2). This causes the locking member 9 to be lifted out of the two toothed rows of serrations 2*a* so that the heel holder 4 can be adjusted along the length of the guide rail 2. The two coaxial axles 9*e* slide upwardly along the length of the two slotted holes 11*b* in the guard plate until the locking member 9 has reached its upper position (see FIG. 2). However, as soon as the screw driver 10 is removed from its operative engagement with the guard plate and locking member, the locking member 9 is again swung clockwise under the influence of the two compression springs 7 into the position illustrated in FIG. 1.

Figure 6:
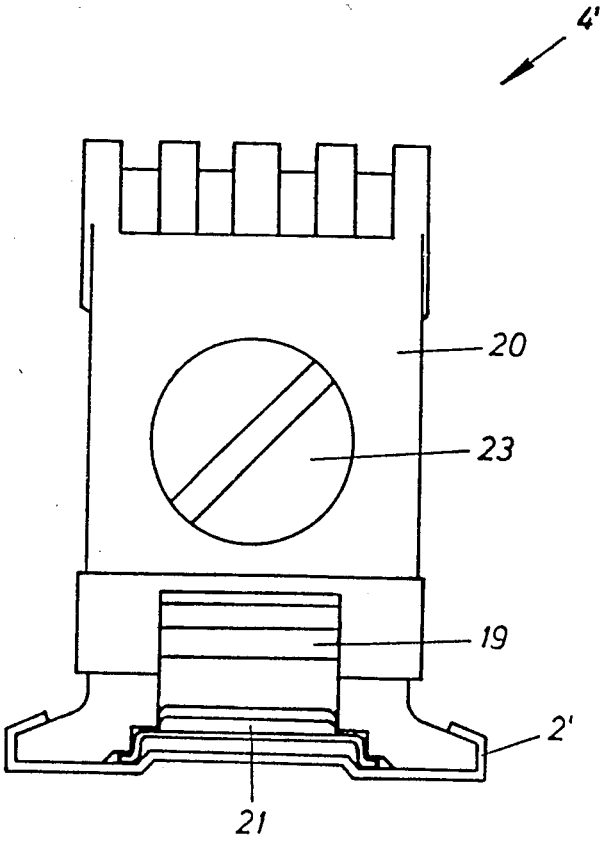
Figure 7:
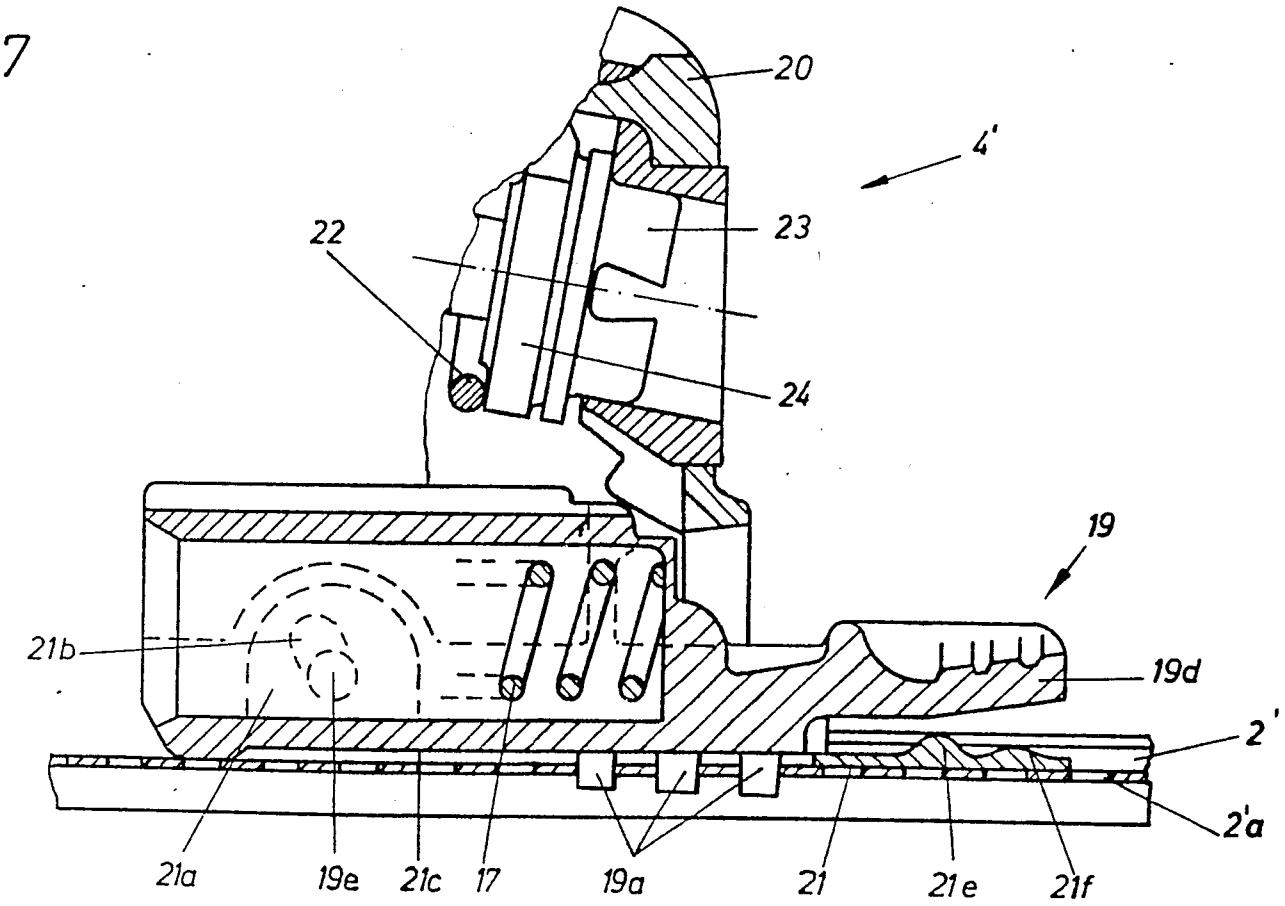

The heel holder according to FIGS. 6 and 7 is identified as a whole by the reference numeral 4'. The heel holder 4' is supported on a guide rail 2', which in contrast to the guide rail 2 of the first exemplary embodiment, is provided with a row of holes 2'*a*. The heel holder 4' has a bearing block 20, in which is stored a locking spring 22. Adjusting structure is provided for adjusting the initial tension by means of a screw 23 which acts onto a spring plate 24.

A locking member 19 is pivotally supported in a not illustrated manner at its end, which is the left end in FIG. 7, in the lower region of the heel holder 4'. The locking member 19 is biassed by a spring 17 which the locking member into the locked position. The locking member 19 has on its underside three locking teeth 19*a*, which are adapted to be received in three of the holes of the row of holes 2'*a*. The end 19*d* of the locking member 19 projects beyond the rear boundary wall of the bearing block 20 and facilitates the engagement of a screw driver, with which the locking member 19 can be pivoted upwardly from the locked or engaged position into the unlocked or disengaged position.

Figure 4:
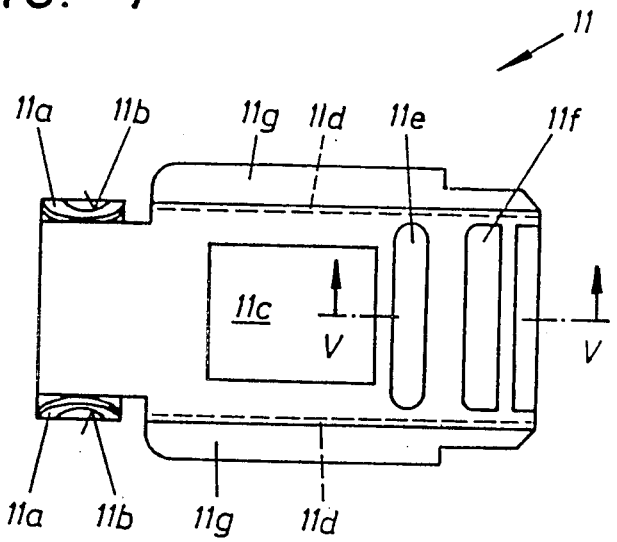
Figure 4A:
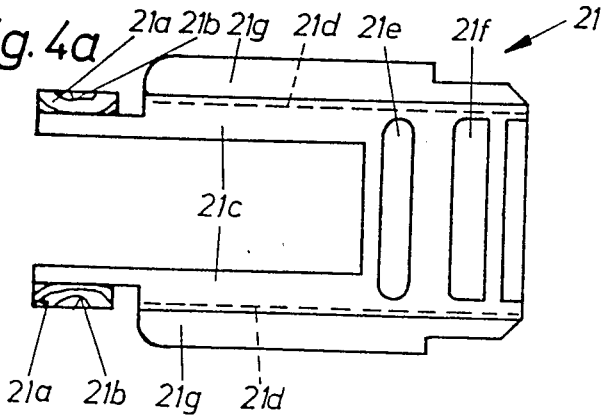
FIGS. 4*a*, 6 and 7 illustrate a second embodiment of an inventive heel holder, namely.

A guard plate 21 is provided below the locking member 19, which guard plate, in contrast to the guard plate 11 according to the first embodiment, as can be seen in connection with FIG. 4*a* is U-shaped in the top view, whereby the bight portion thereof forms the cover area of the guard plate and whereby each of the two legs 21*c* has a bent section 21*a* at their ends into which is provided a slotted hole 21*b*. An axle 19*e* is received into each hole 21*b*, which axles are coaxial and are secured on the locking member 19. Of course, the guard plate 21 also has at its section which projects beyond the rear boundary wall of the bearing block 20 two upstanding ribs 21*e* and 21*f* which extend in a transverse direction and prevent a sliding off of the screw driver from the guard plate. Thus in this design of the guard plate 21, only the area of the perforated guide rail 2', which area is opposite the free end 19*d* of the locking member 19, is covered by the guard plate 21.

The handling of the locking member 19 corresponds with the handling of the locking nember 9, so that a more detailed explanation of the handling is not deemed necessary.

Of course, the invention is by no means to be limited to the exemplary embodiments which are illustrated in the drawings and which are described above. Rather, various modifications of the same are conceivable without departing from the scope of the invention. For example, it is possible to use the guard plate according to the second exemplary embodiment also in the first exemplary embodiment and vice versa. Furthermore, the inventive guard plate can also be used in designs in which the locking member can be locked in the swung-up position on the heel holder.

The embodiments of the invention in which an exclusive property or privilege is claimed are defined as follows:

1. In a heel holder, in particular for a rental ski, which with its underside is guided on a guide rail adapted to be fastened to a ski, said guide rail having at least one toothed segment, said heel holder including a locking member which has at least one toothed segment which can be locked with respect to said guide rail and is biassed by at least one spring, said locking member being pivotal about a transverse axis on said heel holder and projects toward a tail end of said ski beyond said heel holder, the improvement comprising wherein directly below a tail end of said locking member there is arranged a guard plate for covering primarily the section of said toothed segment that lies opposite said tail end area of said locking member so that a tool inserted between said tail end of locking member and said guard plate will be unable to contact said toothed segment on said guide rail and effect damage thereto.

2. A heel holder according to claim 1, wherein means are provided on said guard plate for pivotally supporting said locking member, said means including upstanding bent sections having slotted holes adapted to receive therein coaxial axles on said locking member defining said transverse axis and beign thereby movably supported to a certain degree.

3. A heel holder according to claim 2, wherein the longitudinal axis of said slotted holes defines with the vertical plane an angle in the range 15° to 25° .

4. A heel holder according to claim 1, wherein said guard plate has in its center area a recess for receiving therein the section of said locking member having said teeth thereon.

5. A heel holder according to claim 1, wherein said guard plate which is U-shaped and having laterally spaced arms in the top view hingedly supports said locking member by means of both of said laterally spaced arms which extend the in longitudinal direction of said heel holder toward the spring.

6. A heel holder according to claim 1, wherein said guard plate has in the section juxtaposed said free end of said locking member at least one upstanding rib which extends in transverse direction.

7. A heel holder according to claim 6, wherein two upstanding ribs are provided and wherein said rib which is closer to a tail end of said guard plate is lower than the other rib which is farther from said tail end.

8. A heel holder according to claim 7, wherein the two ribs are constructed as upstanding bulges.

* * * * *